United States Patent [19]

Graef et al.

[11] 4,370,006

[45] Jan. 25, 1983

[54] BANKING MEDIA SECURITY MECHANISM FOR AUTOMATIC BANKING MACHINES

[75] Inventors: Harry T. Graef, Dover; Scott A. Mercer, Hanoverton; Jeffrey A. Hill, North Canton, all of Ohio; Spiro Leontas, Hesperia, Calif.

[73] Assignee: Diebold Incorporated, Canton, Ohio

[21] Appl. No.: 193,847

[22] Filed: Oct. 3, 1980

[51] Int. Cl.[3] ..... E05B 65/04

[52] U.S. Cl. ..... 312/215; 232/15

[58] Field of Search ..... 221/154; 109/24, 24.1, 109/45, 49, 50, 53; 232/15, 16; 312/215, 216, 221; 194/1 A, 1 B

[56] References Cited

U.S. PATENT DOCUMENTS

| | | | |
|---|---|---|---|
| 3,559,877 | 2/1971 | Greenwald et al. | 232/15 |
| 3,741,619 | 6/1973 | Dyer et al. | 312/215 |
| 3,948,376 | 4/1976 | Roman | 194/1 B |
| 4,088,082 | 5/1978 | Pudras | 109/53 |
| 4,113,140 | 9/1978 | Graef et al. . | |
| 4,154,437 | 5/1979 | Butcheck et al. . | |
| 4,186,977 | 2/1980 | Gilovich et al. | 312/215 |

FOREIGN PATENT DOCUMENTS

| | | | |
|---|---|---|---|
| 4436 | 10/1979 | European Pat. Off. | 194/1 B |

*Primary Examiner*—Robert B. Reeves
*Assistant Examiner*—Edward M. Wacyra
*Attorney, Agent, or Firm*—Frease & Bishop

[57] ABSTRACT

An automatic banking or teller machine (ATM) having a plurality of diverse-function, sealed, tamper-indicating containers which are in locked condition when loaded therein including a depository container, a divert container and one or more note containers. The containers while being loaded into the ATM have doors for access openings opened to provide ATM operative status with the containers locked to the ATM. Interlocks are provided between the containers, container locks and the ATM so as to require a predetermined sequence of assembly or disassembly operations to be carried out in assembling or disassembling the containers, without variation or omission.

9 Claims, 26 Drawing Figures

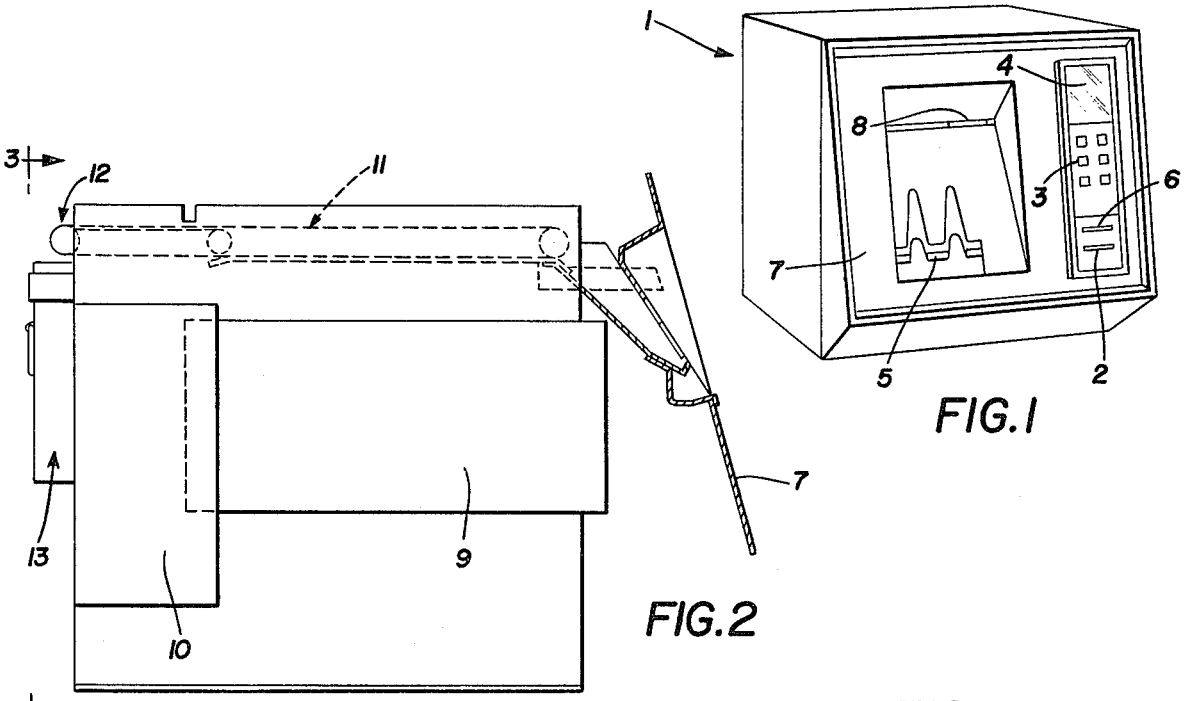
FIG. 1
FIG. 2
FIG. 3
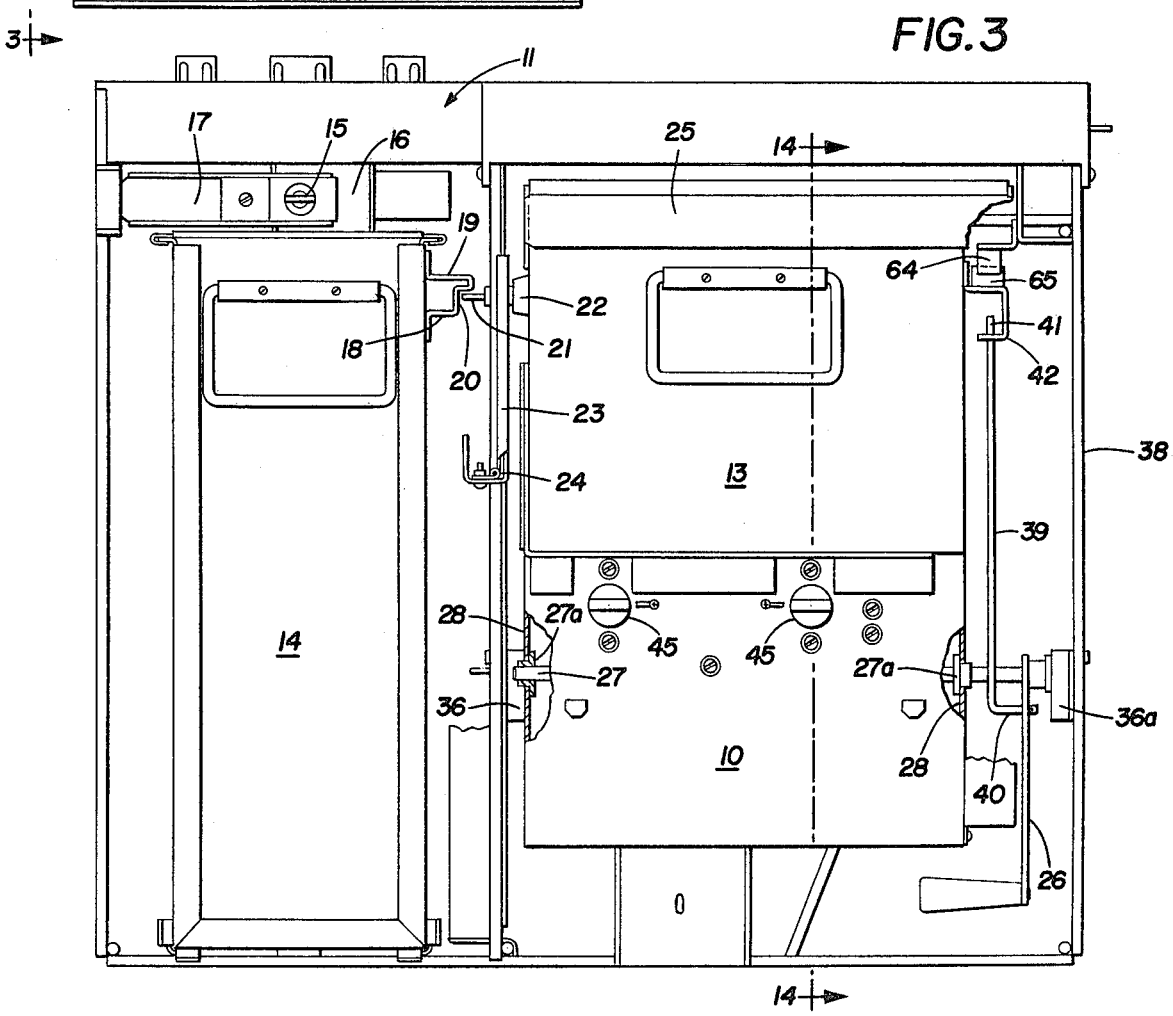

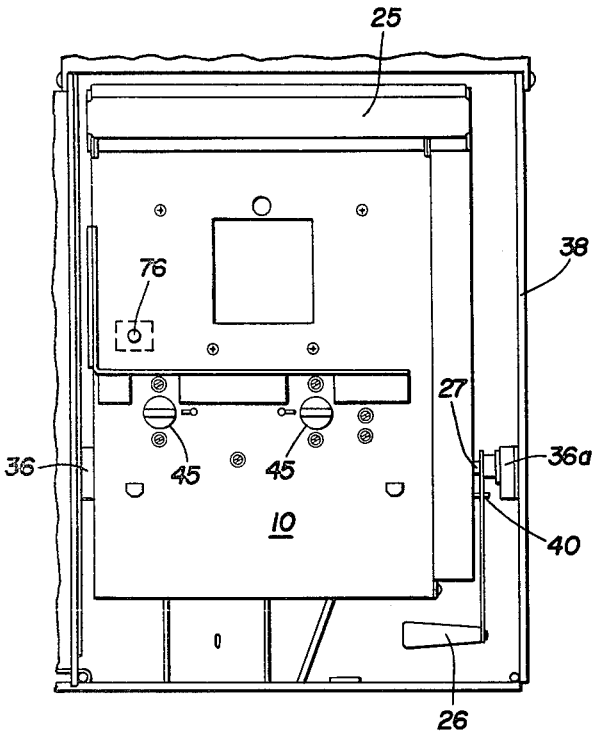
FIG. 10
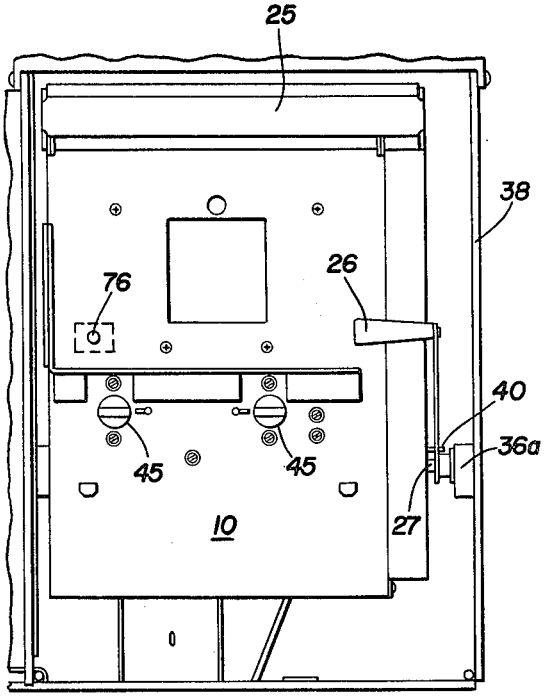
FIG. 11
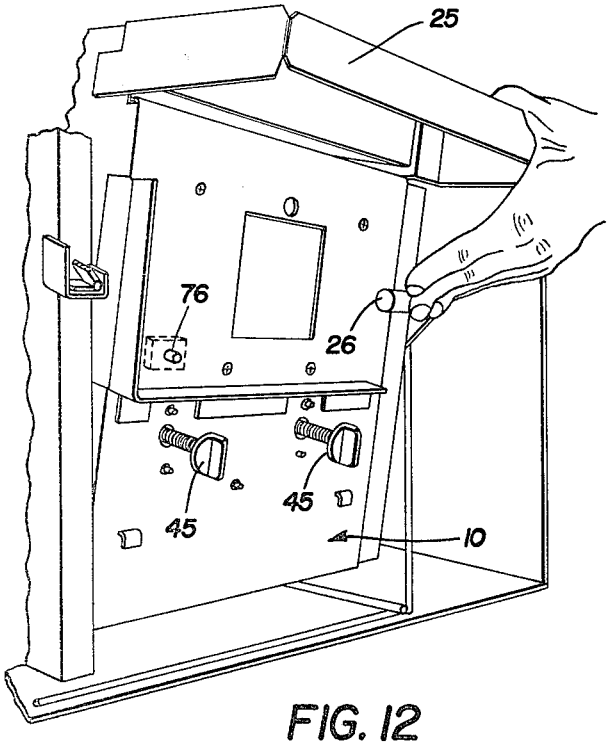
FIG. 12
FIG. 13
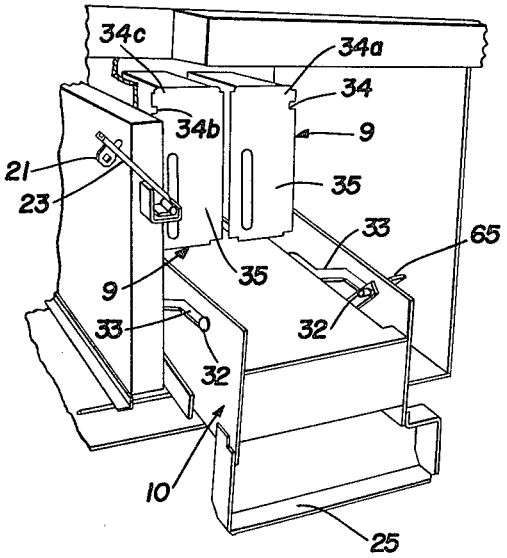

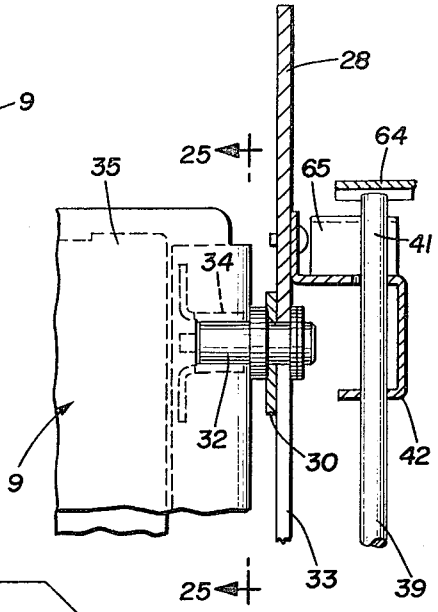
FIG. 24
FIG. 25
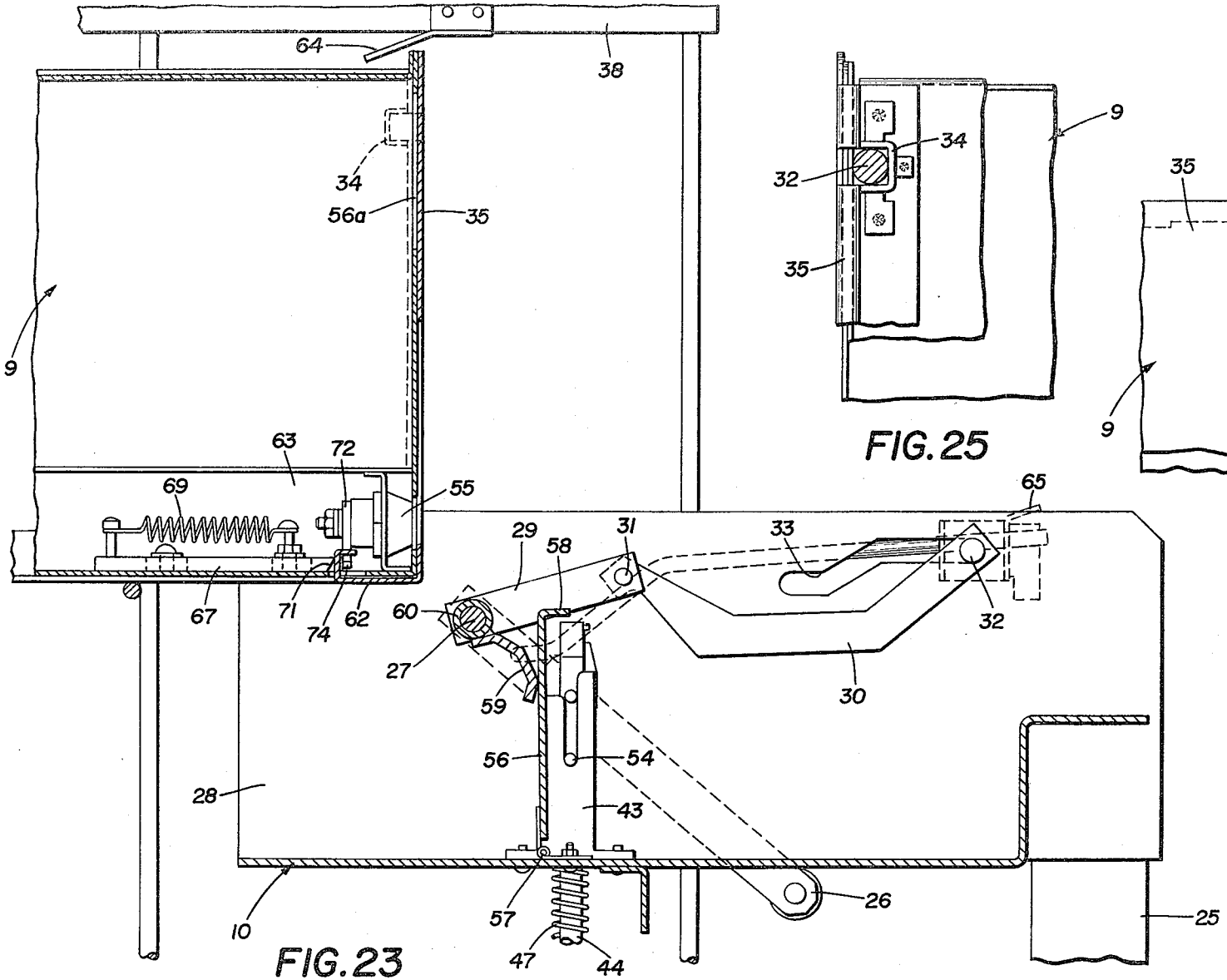
FIG. 23

BANKING MEDIA SECURITY MECHANISM FOR AUTOMATIC BANKING MACHINES

CROSS-REFERENCE TO RELATED PATENTS

The improved security mechanism involves improvements in components that separately are disclosed in U.S. Graef et al. Pat. No. 4,113,140, dated Sept. 12, 1978, U.S. Butcheck et al. Pat. No. 4,154,437, dated May 15, 1979, applicants' copending application Ser. No. 136,528, now U.S. Pat. No. 4,312,277, and applicants' copending application Ser. No. 167,212, now U.S. Pat. No. 4,313,601.

BACKGROUND OF THE INVENTION

1. Field of the Invention

The invention relates to automatic banking or teller machines (ATM's) and particularly to ATM's which may be located at remote locations with respect to a central bank and which include both depository units for deposited materials, and dispensing units for cash or paper money bills or notes of one or more denominations. Further, the invention relates to an ATM in which each denomination of paper money to be dispensed is supplied to the ATM in its own sealed, tamper-indicating container of the general type shown in U.S. Pat. No. 4,113,140.

Further, the invention relates to an ATM which may be equipped with deposit receiving mechanism and a plurality of sealed note containers provided with doubles detecting mechanism, etc., of the general types shown in U.S. Pat. No. 4,154,437.

In addition, the invention relates to an ATM equipped with a sealed depository or deposit-receiving container for banking media of the general type shown in said U.S. Pat. No. 4,312,277.

Further, the invention relates to an ATM equipped with a sealed, tamper-indicating container into which paper money bills are deposited after being diverted from normal dispensing travel following removal from a supply of paper money, of the general type shown in said U.S. Pat. No. 4,313,601.

Finally, the invention relates to equipping an ATM, having depository, note-supply and diverted-note, sealed, tamper-indicating containers, with interlocking controls or mechanisms, coordinated, interrelated, and cooperatively arranged so as to require correct assembly and removal of such sealed container components in a manner such that the ATM is impervious to misloading; thereby providing maximum security for the contents of the sealed depository, note-supply and diverted-note containers at all times.

2. Description of the Prior Art

Many types and kinds of ATM's are known in the banking field. However, said U.S. Pat. Nos. 4,113,140, 4,154,437, 4,312,277 and 4,313,601 are the only relevant prior disclosures of which applicants are aware that show sealed tamper-indicating containers in ATM's. However, the containers in said disclosures are separate and unrelated in receiving deposited material, in housing a supply of notes, and in receiving notes diverted for cause during a dispensing operation.

On the other hand, no prior art of which applicants are aware provides any controls for a plurality of diverse-function sealed containers each of which has its own special devices such as keys, knobs or levers that must be actuated, during assembling or removing such plurality of sealed containers in or from the ATM, to establish container interlocks which require a predetermined sequence of assembly operations to be carried out without variation or omission.

SUMMARY OF THE INVENTION

Objectives of the invention include providing an ATM with a plurality of diverse-function sealed containers including depository, note-supply, and diverted-note containers with interrelated controls arranged such that each control blocks the others unless one after another control is operated in a predetermined sequence without variation or omission, thus preventing accidental skipping of a control operation that is required in such sequence during installation or removal of such sealed containers in an ATM equipped therewith; providing such multiple diverse-function sealed container interlock controls for an ATM so constructed, arranged and interrelated that maximum security for the contents of such containers is maintained at all times while preventing operation of the ATM unless the multiple containers are properly assembled; and providing such diverse-function multi-container equipped ATM's which achieve the stated objectives in an efficient and secure manner, thereby satisfying a need existing in the field of automatic remote cash dispensing and deposit receiving banking equipment and services.

Such objectives are obtained by the construction and arrangement generally stated as including in an ATM having multiple, diverse-function, sealed, tamper-indicating containers removably loaded therein; interlock means operatively connecting said containers one to another and to the ATM when said containers are loaded in the ATM in ATM operative status; and said interlock means including controls constructed and arranged to be actuated in a sequence of steps without omitting any step during assembly or disassembly, thereby rendering the ATM impervious to misloading and maintaining container integrity at all times.

BRIEF DESCRIPTION OF THE DRAWINGS

A preferred embodiment of the invention—illustrative of the best mode in which applicants have contemplated applying the principles—is set forth in the following description and shown in the drawings and is particularly and distinctly pointed out and set forth in the appended claims.

FIG. 1 is a diagrammatic perspective view of a remote ATM unit equipped with the improved security mechanism;

FIG. 2 is a diagrammatic side view illustrating typical components of an ATM having the improved security mechanism for assembling in operative relation a plurality of sealed tamper-indicating containers including, for example, a depository container, a divert container for receiving and storing diverted paper money bills, and one or more note containers loaded with the paper money bills or notes of the desired denomination to be dispensed by the ATM;

FIG. 3 is a diagrammatic elevational view of the equipment shown in FIG. 2 looking in the direction of the arrows 3—3, FIG. 2;

FIG. 10 is an elevational view similar to a part of FIG. 3 after removal of the locked, sealed divert container, showing a pivoted closure-housing latched in closed position with its control handle in latched position, the closure housing enclosing note containers;

FIG. 11 is a view similar to FIG. 10 with the control handle moved to a position permitting captive keys mounted on the closure housing and engaged with note container locks in unlocked position, to be moved to locked position when said captive keys may be disengaged from their note container locks;

FIG. 12 is a fragmentary perspective view of certain components illustrated in FIGS. 10 and 11, with the control handle moved to a position to unlatch the closure housing, whereby it may be opened, initial opening movement of the closure housing being illustrated;

FIG. 13 is a fragmentary perspective view similar to FIG. 12 with the closure housing in open position permitting access to and removal of the locked, sealed note containers;

FIG. 23 is a view similar to FIG. 22 showing the closure housing pivoted to open position to expose the locked, sealed tamper-indicating note containers which can be removed from the ATM;

FIG. 24 is a fragmentary sectional view looking in the direction of the arrows 24—24, FIG. 22; and FIG. 25 is a fragmentary view looking in the direction of the arrows 25—25, FIG. 24.

Similar numerals refer to similar parts throughout the various Figures of the drawings.

DESCRIPTION OF THE PREFERRED EMBODIMENT

Figure 4:
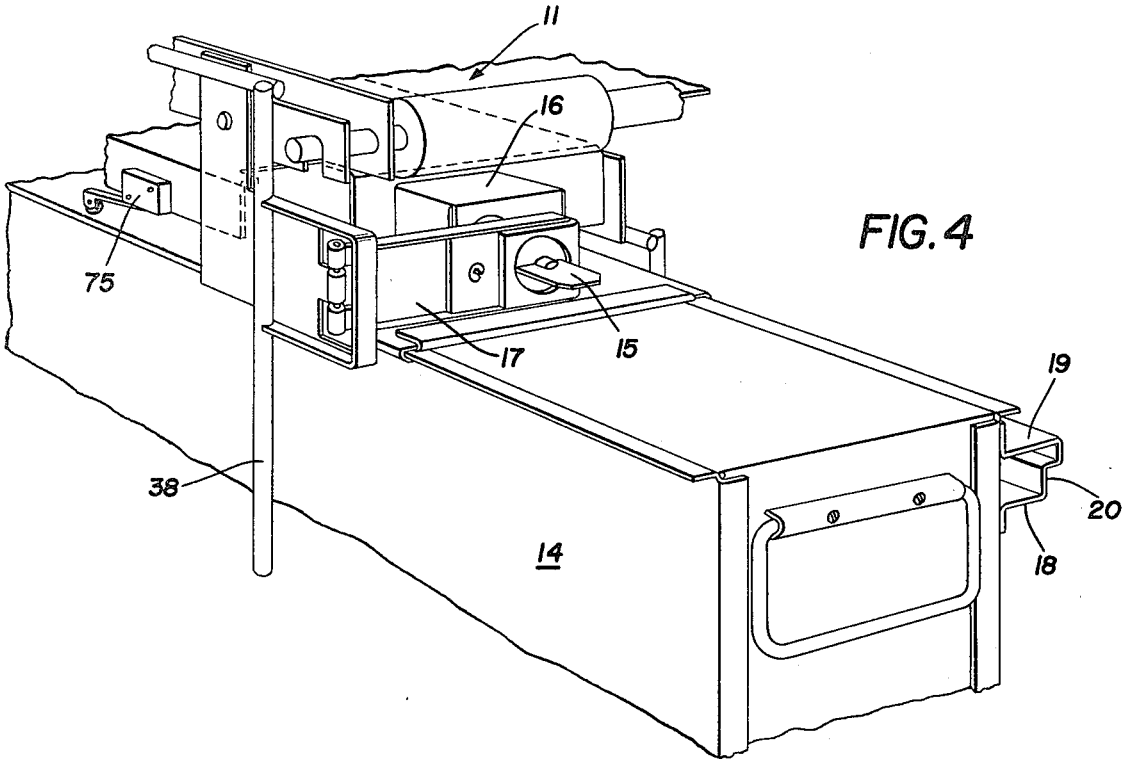
FIG. 4 is a fragmentary perspective view of a depository container, such as shown in operative position in FIG. 3, being removed from the ATM but before the container is locked by its key held captive by the ATM.

A typical ATM for dispensing currency in response to the presentation by a bank customer of coded card means is diagrammatically illustrated at 1 in FIG. 1. Such an ATM may be energized when a customer presents or enters a coded card into slot 2. The coded card is verified to confirm that it is an authorized card and that the user thereof is the authorized user, through a card reader and other known devices contained in the ATM 1 or electrically connected thereto.

After the card and customer verification has been carried out, keyboard entries may be made by the customer at 3 in accordance with instructions presented to the customer at instruction panel 4. The entries, among other matters, may indicate the amount of currrency that the customer desires to withdraw, or may indicate that the customer desires to conduct another type of banking transaction.

If currency is to be dispensed, it may be delivered from dispenser mechanism within the unit 1 at the cash dispenser station or customer access note delivery receptacle 5. A record of or receipt for the transaction may, in some instances, be issued to the customer through receipt slot 6. The card entry slot 2, the keyboard 3, the instruction panel which may be a TV screen 4, the currency delivery receptacle 5, and the receipt slot 6 all are preferably formed in or carried by the recessed facia panel means 7. An envelope entry slot 8 also may be formed in facia panel 7 to receive material to be deposited in the ATM.

Cash dispenser and possible related components are generally diagrammatically illustrated in FIGS. 2 and 3 and may include one or more note containers 9 for supply stacks of paper money in the form of notes of one or more denominations protectively held in the container or containers 9. Such note containers may be of the type shown in U.S. Pat. No. 4,113,140 wherein the containers are identified as sealed tamper-indicating money dispenser containers. Any desired number of such note containers for currency of different denominations may be present in an ATM. The note container or containers 9 may have associated therewith picker mechanism located in a closure housing 10. The picker mechanism may be any desired type of mechanism for picking paper money notes, one at a time, from stacked supplies thereof, such as in note containers 9, and for feeding the same, bill by bill, to other components of the ATM.

The ATM components diagrammatically shown in FIGS. 2 and 3 may also include doubles detect mechanism, not shown but similar to such mechanism described in U.S. Pat. No. 4,154,437 over which the concepts of the present invention comprise improvements, FIGS. 1, 2 and 3 being generally like similar views in U.S. Pat. No. 4,154,437.

As described in said U.S. Pat. No. 4,154,437, notes to be dispensed are delivered by the picker mechanism to transport means, such as the conveyor generally indicated at 11, for delivery to the note delivery receptacle 5. As the notes are delivered to the conveyor 11, they pass through a doubles detect zone which detects the presence of doubles. When doubles are detected, the conveyor 11 is reversed and the detected doubles are diverted to movement by the conveyor in the opposite direction and are discharged at the conveyor divert discharge end 12 into a divert container 13. Such divert container construction and operation in dispensing notes may be generally similar to that shown and described in said U.S. Pat. No. 4,313,601 modified as disclosed herein.

Material which a customer may wish to deposit in the ATM is inserted preferably in envelopes through the envelope entry slot 8 and is conveyed by a conveyor in the ATM and discharged into a depository container 14. The depository container 14 may be of the general type shown in said U.S. Pat. No. 4,312,277 and its operation coordinated with a conveyor and a barrier or deflector device such as shown in said U.S. Pat. No. 4,312,277, to deliver the deposited materials into the depository container. The latter may be locked or unlocked by a captive key or other lock actuating means during removal of or assembly of the depository container from or with the ATM as described in said U.S. Pat. No. 4,312,277.

The concepts of the present invention relate to modifications in the manner of mounting or assembling in an ATM, one or more note containers, a divert container, a depository container and a closure housing for the note container or containers. Important facets of the concepts involve the interrelationships and interlocks existing and established between such note, divert and depository containers and the closure housing. Such relationships, etc., require assembly and disassembly of the containers in one way and one way only so that only sealed tamper-indicating and locked containers can be installed in the ATM in a certain order of assembly; and so that upon removal of such containers they must be locked to maintain their integrity as sealed tamper-indicating containers for transporting money in the form of notes or deposited material between a central bank and remote ATM's. Such a system involves delivery by security personnel of sealed note containers at desired intervals from a central bank to remote ATM's. At the time when filled note containers are installed at a remote ATM unit, those ATM note containers being replaced are removed. It is convenient at the same time to collect and replace the divert and depository containers also, located in the particular ATM and to deliver them to the central bank so that maximum security is always maintained regarding the valuable paper money notes within the note and divert containers and the valuable deposited material in the depository container.

In general, the procedure for removing the various containers from an ATM involves the opening of a safelike door at the back of the unit 1 (not shown) which renders the containers in the unit 1 accessible as viewed in FIG. 3.

Figure 5:
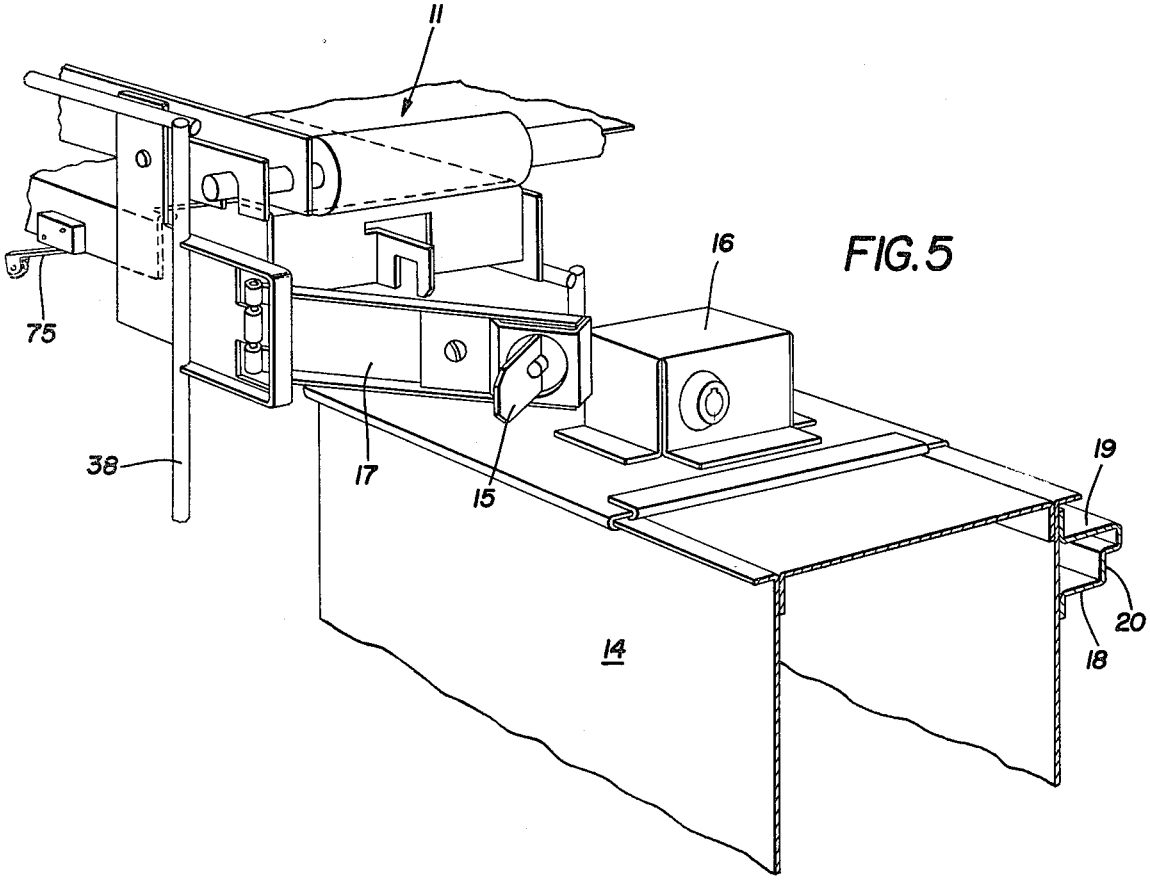
FIG. 5 is a fragmentary view similar to FIG. 4 showing the depository container lock after locking by its captive key, the captive key being moved out of the way of the container on its pivotal mounting bracket, and the depository container almost completely removed from the mechanism.

The first step is to pull the depository container 14 along its slide mounting to the position shown in FIG. 4 which closes the door for the access opening of the container as described in said application Ser. No. 136,528. At this time, the captive key 15 for the depository container which may be sealed from undetectable removal from the mounting bracket 17 by any suitable means such as a lead and wire seal, shown with its handle horizontal in FIG. 4 is in a position unlocking the lock. The key is turned to a vertical position of the key handle as shown in FIG. 5 to lock the depository container lock 16 which permits the key 15 to be withdrawn from the lock 16 but captive on its pivoted mounting bracket 17. The bracket 17 is then moved to the position shown in FIG. 5 clear of the lock 16. At this time, the locked, sealed tamper-indicating depository container 14 may be completely removed from the ATM. Thus far, the procedure and operation of the depository container during removal is as described in said application Ser. No. 136,528.

However, the construction of the depository container 14 is modified by providing a rail 18. The rail 18 has a shoulder 19 forming an interlock recess 20.

The interlock recess 20 (FIG. 3) so long as the depository container 14 is installed in the ATM 1, prevents the handle of the trapped key 21 for the divert container 13 from being moved to change the unlocked status of the key 21 and its lock 22 on the divert container 13. The handle of trapped divert container key 21 extends in a horizontal direction as shown in FIG. 3 when the lock 22 is unlocked which means that the closure member of the divert container 13 is in open position to receive diverted bills that may be discharged into the container 13 as shown and described in said U.S. Pat. No. 4,313,601.

The divert container key 21 (which may be sealed from undetectable removal by a lead and wire seal such as described concerning key 15) is mounted at the upper end of a pivoted bracket 23 which enables removal of the key 21 from the lock 22 when the divert container closure is closed and locked, the bracket 23 being pivoted at 24 on a frame member of the ATM.

In this manner the rail 18 and its recess 20 on the depository container and the divert container key 21 are interlocked to prevent removal of the divert container 13 until the depository container 14 is removed and to require removal of the depository container 14 before components of the divert container 13 are accessible to permit removal of the divert container 13.

Figure 6:
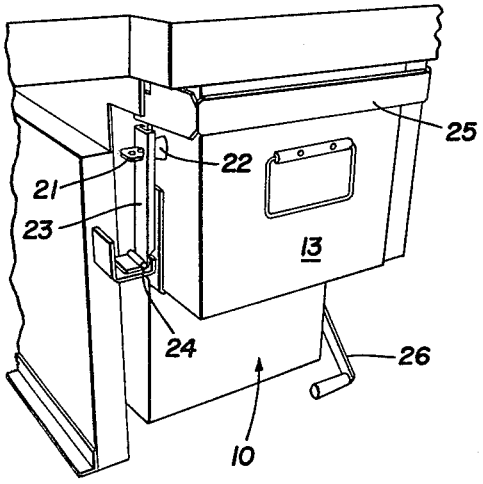
FIG. 6 is a fragmentary perspective view of the divert container with its trapped captive key in container unlocked position, but accessible because of removal (FIG. 5) of the locked depository container.

At this point in the description of removing the various sealed containers from the unit 1, the depository container 14 has been removed but other components of the equipment are in the positions shown in FIG. 6. At this time the handle of the divert container key 21 extends horizontally as shown in FIG. 6 which is the position in which it is held by the rail 18 on the depository container 14 until the latter is removed from the ATM.

Figure 7:
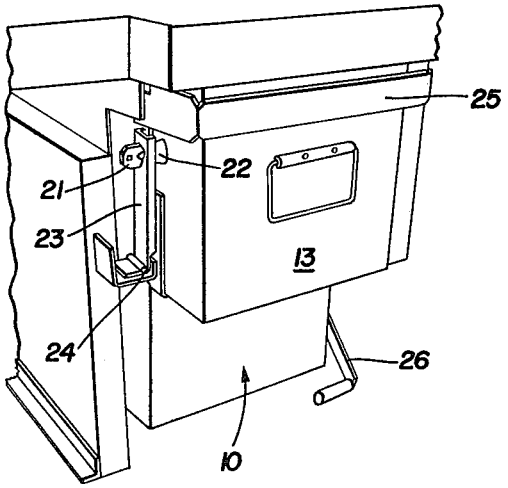
FIG. 7 is a view similar to FIG. 6 but showing the divert container captive key turned to a position locking the divert container and permitting removal of the trapped key from the container lock and then removal of the divert container from the ATM.
Figure 8:
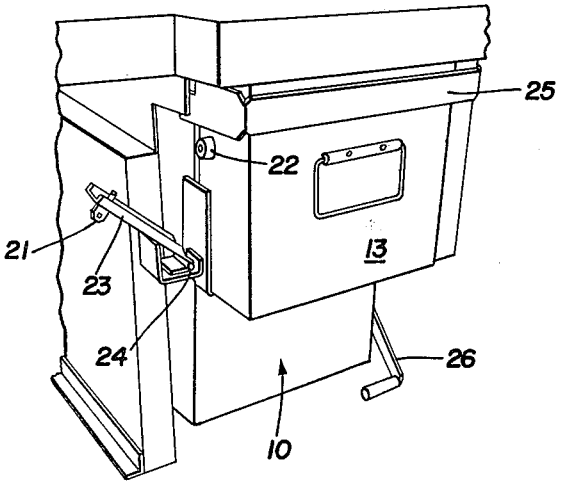
FIG. 8 is a view similar to FIGS. 6 and 7 but showing the captive divert container key removed from the divert container lock by pivotal movement of the key-mounting bracket which holds the key trapped to the ATM.
Figure 9:
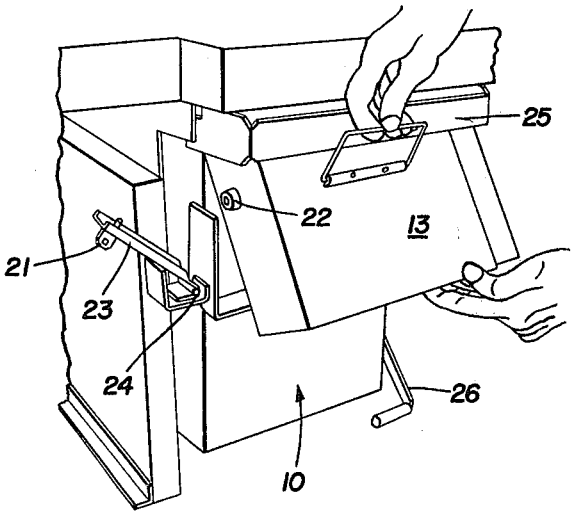
FIG. 9 is a view similar to FIGS. 6, 7 and 8 but showing the divert container being removed from the ATM.

It is now possible to turn the key 21 to the position shown in FIG. 7 with the key handle extending vertically as shown which locks the divert container 13 in closed status. At this time the key 21 may be withdrawn from the divert container lock 22 by pivoting the key mounting bracket 23 laterally outward and downward from the divert container 13 as shown in FIG. 8. The key 21 now is clear of the divert container which permits the divert container 13 to be tilted as shown in FIG. 9 to permit its removal from the ATM after tilting by downward movement to clear the retainer member 25. This procedure for removal of the divert container 13 from the ATM and its release from the retainer 25 is shown and described, as well as the construction of the container 13, in said U.S. Pat. No. 4,313,601.

The divert container 13 thus removed from the ATM is a locked, sealed tamper-indicating container and the remaining related components of the unit are in the positions diagrammatically shown in FIG. 10 wherein the closure housing 10 is completely exposed and accessible.

Figure 16:
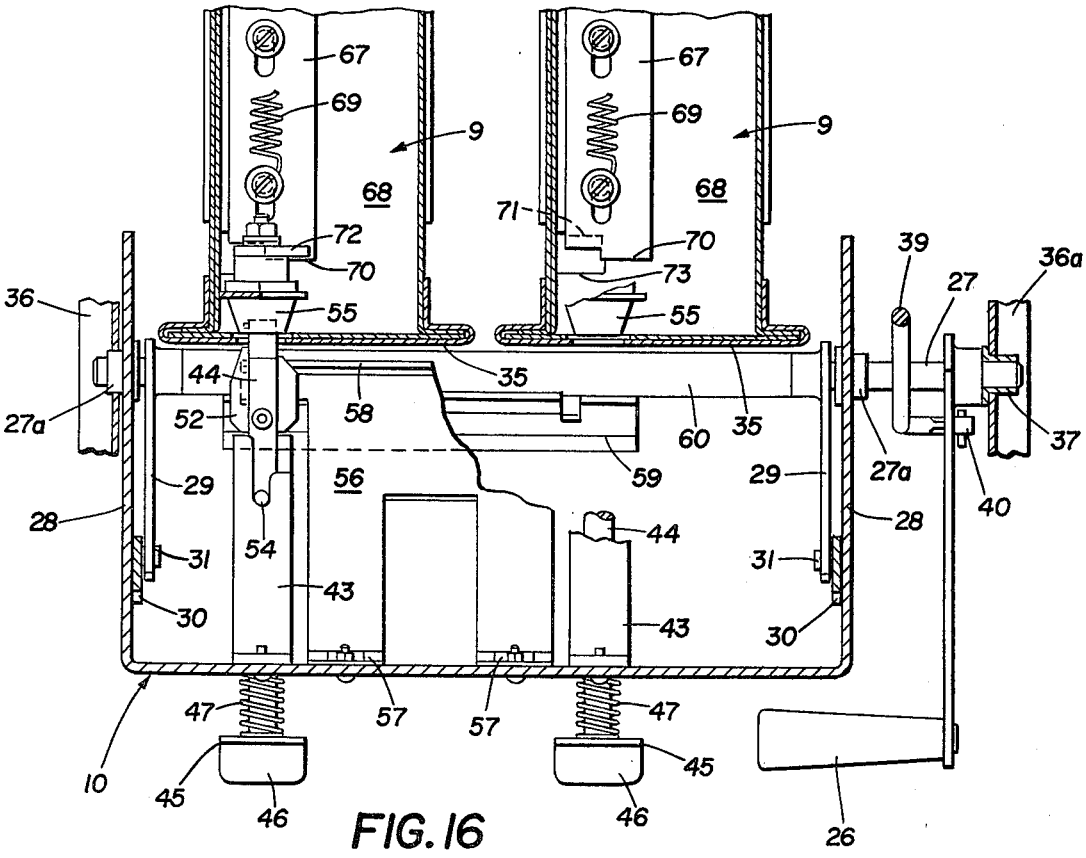
FIG. 16 is a plan sectional view taken on the line 16—16, FIG. 14.

Until the divert container 13 is completely removed as described, it blocks access to much of the closure housing 10, and prevents movement of the closure housing control handle 26 to unlatch the closure housing 10. Stages in control handle movement are described below, from the position shown in FIG. 10 to the unlatched position shown in FIGS. 12 and 16. In the unlatched condition the closure housing 10 may be moved to open position, initial opening movement being shown in FIG. 12 and the fully open position being shown in FIG. 13.

Accordingly, the divert container 13, until removal, provides an interlock with the closure housing 10 and its control handle 26, preventing the closure housing 10 from being unlatched to be opened until the divert container is removed, and requires removal of the divert container 13 before various components of the closure housing, including its control handle 26, can be manipulated to permit access to note containers 9 which are enclosed by closure housing 10.

Figure 14:
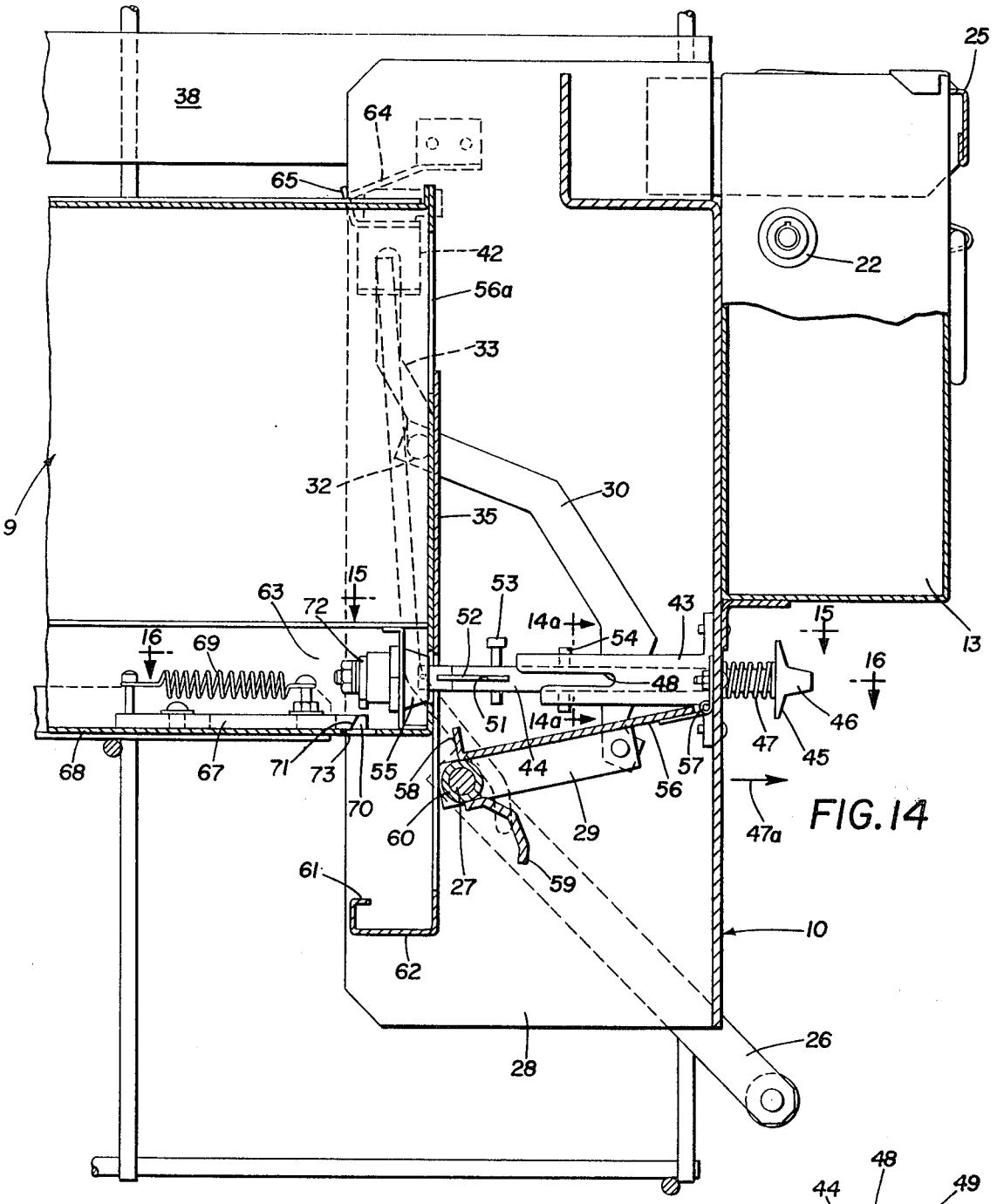
FIG. 14 is a sectional view taken on the line 14—14, FIG. 3, illustrating control mechanism actuated by the closure housing control handle.
Figure 15:
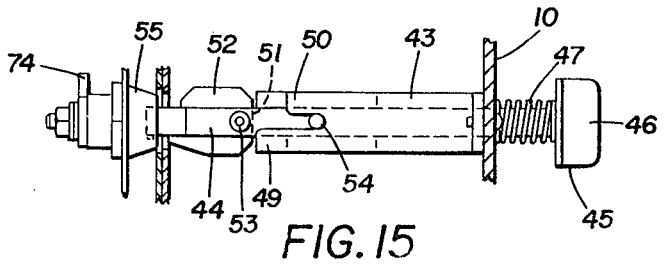
FIG. 15 is a fragmentary plan view looking in the direction of the arrows 15—15, FIG. 14.

Details of the control housing 10 and various devices mounted thereon are shown in FIG. 14 wherein the divert container 13 also is shown before removal from the unit as described immediately above. The control handle 26 is there shown in its normal position.

A shaft 27 is journaled at its ends in bushings 27*a* mounted in each of spaced side walls 28 of the closure housing 10. The control handle 26 is fixed to one end portion of the shaft 27 outside of one of the side walls 28, to the right as shown in FIG. 3. Lever arms 29 also are fixed to the shaft 27 adjacent the side walls 28 inside the housing 10 and angular levers 30 are pivotally connected at 31 to the outer ends of the levers 29 at ends of the levers 30. The other ends of levers 30 have pins 32 mounted thereon projecting toward each other inside of housing 10. One end of each pin 32 projects through a cam slot 33 formed in each housing side wall 28. The other pin ends project into and engage respective boxlike recesses 34 formed in sliding doors 35 for the two note containers. One of such pin ends engages a recess 34 formed in one corner 34*a*, adjacent one housing wall 28, of the sliding door 35 for one of the note containers 9, and the pin 32 on the other lever 30 projects into the similar boxlike recess 34*b* in a corner 34*c* of the other note container door 35 adjacent the other housing wall 28. This prevents any note container from being loaded in the ATM at an improper location.

The housing 10 also is journaled for rotary opening and closing movement on the axis of the shaft 27. This is accomplished by providing a mounting bracket 36 on the unit frame 38 at one end of the shaft 27 in which the bushing 27*a* for that end of the shaft is externally journaled. The other end of the shaft 27 on which the control handle 26 is mounted has a bushing 37 thereon (FIG. 3) which is journaled exteriorly in a mounting bracket 36*a* carried by the unit frame 38. In this manner the shaft 27 is journaled on unit frame 38, and the housing 10 is journaled on the shaft 27 for rotary movement on the shaft axis, shaft movement being controlled by the control handle 26.

A push rod 39 has a lower L-shaped end 40 connected with the control handle 26, and its upper end 41 is movable longitudinally up and down through a guide bracket 42. The push rod 39 moved by the control handle 26 unlatches the housing 10 as described below.

Two mounting and guide members 43, one for each note container 9, are mounted on and inside of housing 10 (FIG. 14). Each of members 43 has a longitudinal bore 43*a* through which a key-actuator rod 44 extends. The outer end of each rod 44 is located outside of the housing 10 and is provided with a control knob 45 having an outer indicator handle 46. A spring 47 reacts between a wall of the housing 10 and the knob 45 normally biasing the key-actuator rod 44 in the direction of the arrow 47*a* outward of the housing 10.

Figure 14A:
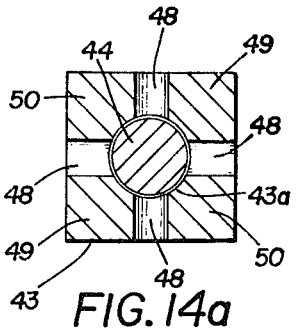
FIG. 14*a* is an enlarged fragmentary section taken on the line 14*a*—14*a*, FIG. 14.

The inner ends of the mounting members 43 are formed with slots 48 oriented cross-shaped in cross section (FIG. 14*a*) which form diagonally opposite long fingers 49 and diagonally opposite short fingers 50. Each key-actuator rod 44 has a slot 51 in its inner end into which the handle of a key 52 for one of the two note containers 9 is inserted and held in position by a sealed, tamper-indicating screw 53 which may have a lead and wire seal secured thereto. The key 52 thus cannot be removed from actuator rod 44 without any indication of tampering. Spaced to the right of the screw 53 (FIG. 14) is a pin 54 extending through the rod 44 vertically at right angles to the horizontal plane of the handle of key 52. The key handle plane 52 is oriented in the same manner as the plane of the handle 46 of the key-actuator knob 45.

As shown in FIG. 14, which is the closed position of the housing 10 with the ATM unit 1 in operative condition to dispense notes from the note containers 9, the key 52 is engaged in the container lock 55 with the lock 55 unlocked and the sliding door 35 in open position to expose the access opening 56*a* for container 9 to permit paper money bills therein (not shown) to be picked through opening 56*a* by picker mechanism (not shown) of any desired type and located in the housing 10. The note containers and their operation and installation, per se, in an ATM may be of the general type shown in said U.S. Pat. No. 4,113,140.

The location of note containers 9, with respect to the closure housing 10 when closed and in cash dispensing condition and with the control handle 26 down in normal position, is shown in FIG. 14. This operative position is determined when the control handle 26 is in normal down position, and the angular levers 30 and their pin portions 32 are at the lower ends of the cam slots 33. At this time, the inner projecting ends of the pins 32 engaged in the boxlike recesses 34 and 34*b* of the note container doors 35 have moved the doors 35 downward to the open position (FIG. 14) in a manner to be described below.

Likewise, at this time, each note container key 52 is held against movement to unlock its lock 55 by engagement of the pin 54 in the top and bottom slots 48 of the guide member 43, the guide member fingers 49 and 50 preventing rotation of the key actuator rod 44.

Also located in the housing 10 is a key probe plate 56 pivotally mounted at 57 on the front wall of the housing 10 having a generally upstanding probe flange 58 at its outer edge. The probe plate 56 is engaged by a push lever plate 59 mounted on a sleeve 60 surrounding shaft 27 and extending between the lever arms 29, and sleeve 60 is rotated along with movement of control handle 26.

Figure 17:
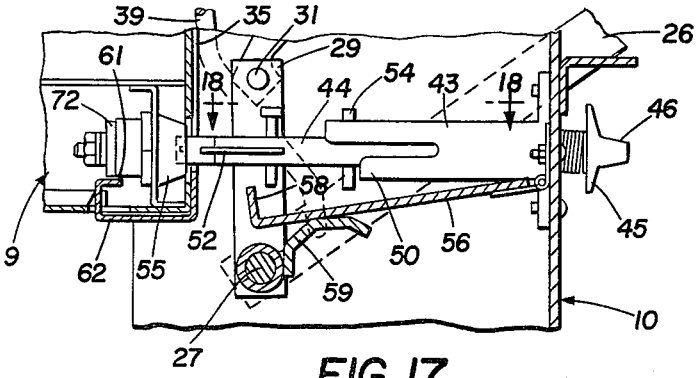
FIG. 17 is a view similar to FIG. 14 showing the control handle moved to an intermediate position.
Figure 20:
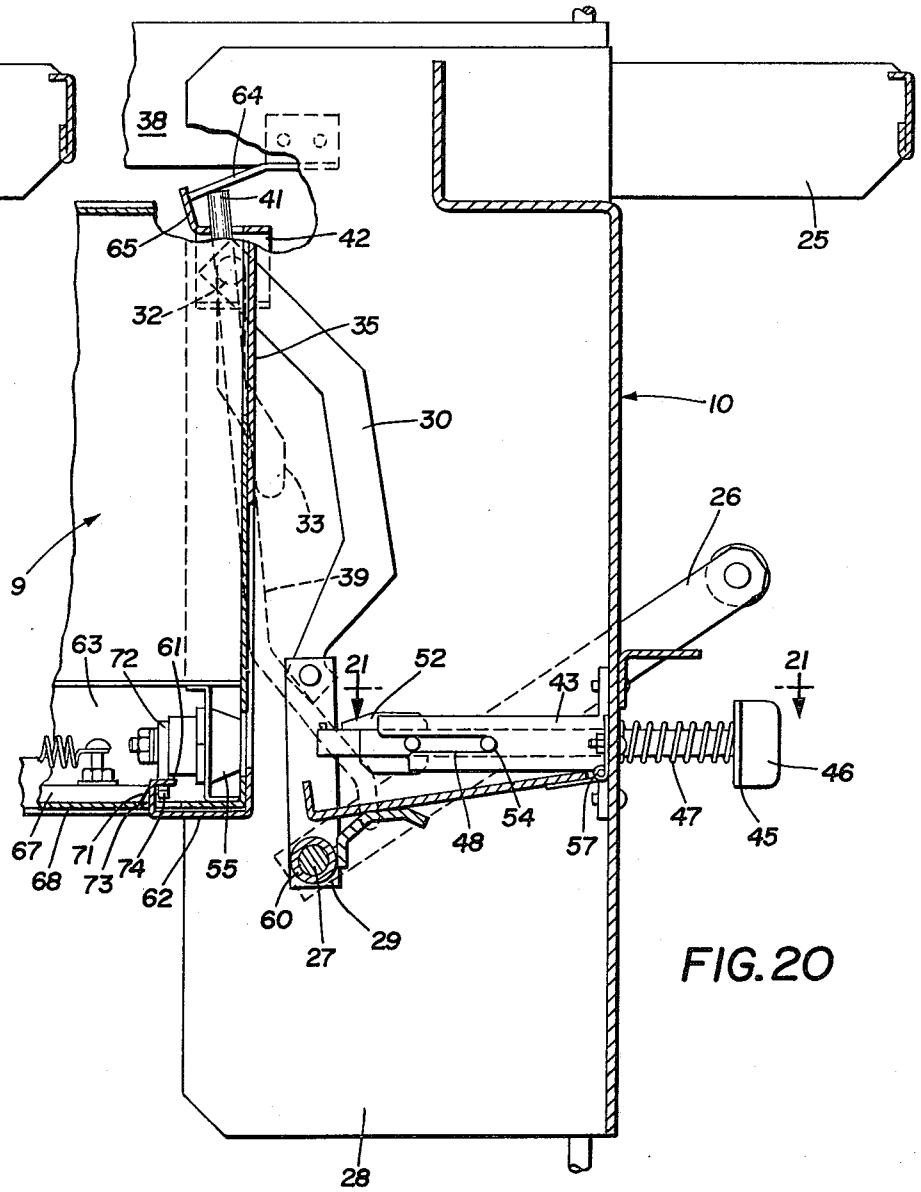
FIG. 20 is a view similar to FIG. 17 but showing the knobs and key holders for the note container keys rotated 90° to lock the note container locks, and showing the keys removed from the locks.

Now returning to the status of the equipment during removal of the sealed containers, the divert container 13 having been removed as described, then control handle 26 may be moved to the intermediate position shown in FIG. 17. At this time, movement of the control lever 26 has moved pin 32 at the end of angular lever 30 to the top of cam slot 33 (as shown in FIG. 20) and has raised the sliding door 35 of note container 9 to closed position with the re-entrant end 61 of its bottom flange 62 entered into a recess 63 in the bottom wall of note container 9 adjacent the container lock 55.

Movement of the pin 32 in cam slot 33 while the pin 32 is engaged in the container boxlike recess 34 results in movement of the container 9 to the left from the position shown in FIG. 14 to that shown in FIG. 17. Meanwhile, each container key 52, which is engaged in its lock 55 in the unlocked position, pulls its actuator rod 44 from the position of FIG. 14 to the position of FIG. 17 with its respective knob 45 closer to the front wall of housing 10 as shown.

Figure 18:
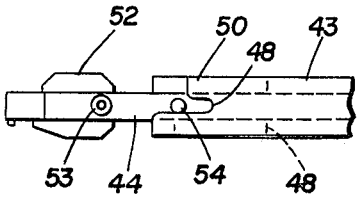
FIG. 18 is a fragmentary plan view looking in the direction of the arrows 18—18, FIG. 17.

Thus, the axial movement of the key actuator rod 44 to the left in FIG. 17 is accompanied by movement of the pin 54 to clear the ends of the short fingers 50 of the guide member 43 (FIG. 18), so that the knob handle 46 may turn the actuator rod 44 to move the key 52 from unlocked to locked position.

Figure 19:
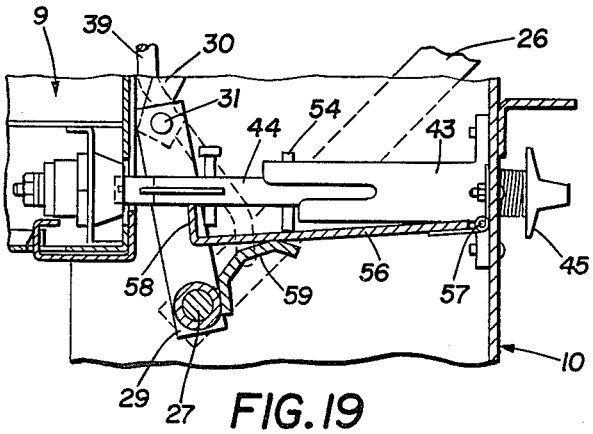
FIG. 19 is a view similar to FIG. 17 but showing interference of the probe plate by the key actuator when attempting to move the control handle beyond intermediate position.

Also, movement of the control handle 26 to the intermediate position shown in FIG. 17 moves the key probe plate 56 to the position shown in FIG. 17. Such probe plate movement results from movement of the push lever plate 59 which rotates about shaft 27 along with control handle 26 movement, and which push lever plate engages the probe plate as shown. At this time, an attempt to move the probe flange 58 further upward is prevented by the actuator rods 44 which extend across the path of movement of flange 58 and prevent further upward movement of the control handle 26, as shown in FIG. 19.

At this time, the knobs 45 may be grasped to rotate the actuator rods 44 and the keys 52 carried thereby clockwise, viewing the ends of knobs 45. This orients the knob handles 46 in a vertical position as shown in FIG. 20, whereupon the locks 55 are locked and the key actuators 44 automatically are retracted by the springs 47 to disengage the keys from the locks and position the actuator rods 44 as shown in FIG. 20.

Figure 21:
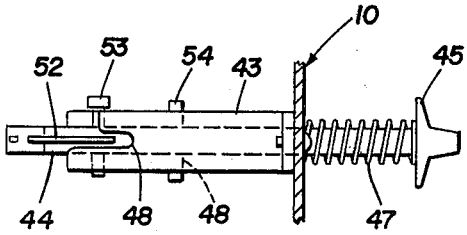
FIG. 21 is a fragmentary plan view looking in the direction of the arrows 21—21, FIG. 20.

During retraction of the actuator rods 44, the pins 54 move into the horizontal slots 48 of guide members 43 to hold the actuator rods 44 in the positions shown in FIGS. 20 and 21 with the knob handles vertical indicating that the container locks 55 are locked.

Figure 22:
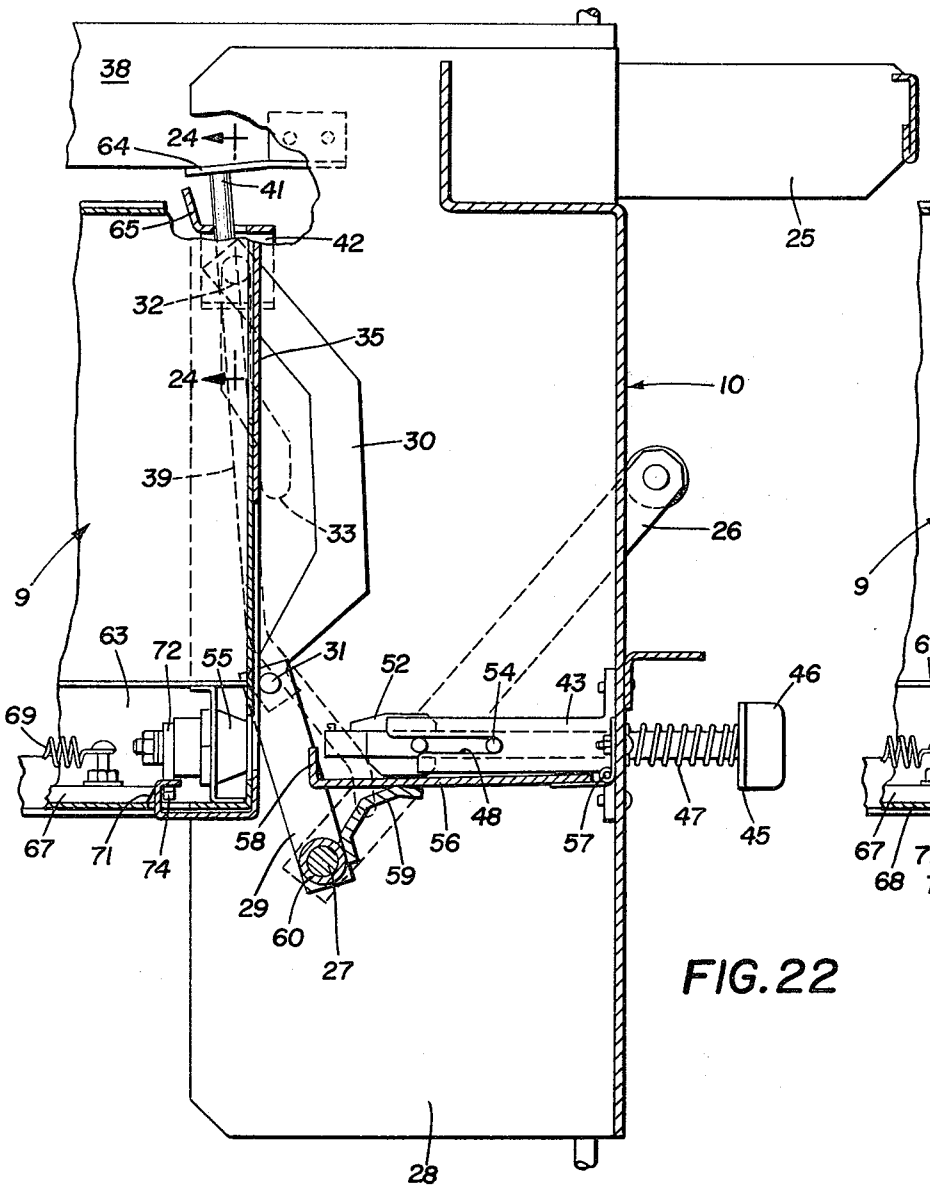
FIG. 22 is a view similar to FIG. 20 but showing the control handle moved completely to a position unlatching the latched connection of the closure housing to the ATM.

At this time, the control handle 26 may be moved from the position of FIG. 20 to that of FIG. 22. Such movement is possible because the ends of the note container keys 52 carried by the actuator rods 44 are clear of the probe flange 58 so that the key probe plate 56 can be moved to a horizontal position shown in FIG. 22 by the push lever plate 59 and thus permits the control handle 26 to move to the position shown in FIG. 22.

The closure housing 10 normally is held latched in closed position, as shown in FIG. 20, by a latch spring blade 64 mounted on the unit frame 38 (FIGS. 3 and 20) which engages an angular flange 65 formed on the guide bracket 42 for the push rod 39. During movement of the control handle 26 from intermediate position shown in FIG. 20, to the unlatched position shown in FIG. 22, the push rod 39 is moved upward so that its upper end 41 engages the latch spring blade 64 moving it to unlatched position disengaged from the angular flange 65 as shown in FIG. 22. As the housing 10 is unlatched, its retainer member 25 or handle 26 may be grasped to move the housing on its pivot axis (shaft 27) to the housing open position of FIG. 23. This exposes the note containers 9 for removal from the ATM in locked, sealed tamper-indicating condition.

As previously described, the sliding door 35 for each note container has been moved to closed position before locking the container lock 55 during movement of the control handle 26 from the normal position shown in FIG. 14 to the intermediate position shown in FIGS. 17 and 20 by the pin 32 carried by the angular lever 30 engaged in the boxlike door recess 34. When the note container sliding door 35 reaches fully closed position as the control handle 26 is moved to intermediate position, the pins 32 are free to be released from the boxlike recesses 34 and 34*b* (FIG. 24) when the unlatched housing 10 is opened.

There is an additional safeguard provided for each note container 9 best illustrated in FIGS. 14 and 20. A slide member 67 is mounted within the container 9 on the container wall 68 biased by spring 69 toward the right. The slide member 67 has a blocking finger 70 and an adjacent slanted portion 71. The bolt 72 of the lock 55 has a hook-shaped tongue movement of which is blocked by the blocking finger 70 of the slide member 67 when the container door 35 is in the open position of FIG. 14.

As the door is closed to the position of FIG. 20, the re-entrant end or finger 61 of the door bottom flange 62 moves through an opening 73 in the container wall 68 and engages the slanted portion 71 of the slide member 67 to move the slide member to the left so that its blocking finger 70 does not block locking movement of the bolt 72.

In this manner, the hook-shaped tongue of the container lock bolt 72 may be moved so that said hook-shaped tongue, indicated at 74 in FIG. 20, when rotated during locking of the lock 55 can engage beneath the re-entrant end 61 of the door bottom flange 62 thereby locking the door in closed position.

This safeguard, in effect, provides an interlock between the closure housing 10 and its control handle 26 so that when these components are manipulated ultimately to open the housing 10 for removing note containers 9, the container door 35 must be in fully and completely closed position actuating the slide member 67 to unblock the locking bolt 72 so that it may be moved from unlocked to locked position of FIG. 20.

In other words, the interrelationships and interlocks between various components including note containers 9, the closure housing 10 and control handle 26, etc., require that the containers 9 be locked before the housing 10 can be opened to remove the containers 9 from the ATM.

Disassembly of the ATM 1 to remove various sealed tamper-indicating containers in locked condition and the steps that must be taken in the order described, has been set forth in detail above.

The sequence for removing the sealed containers is briefly described below. Initially, every control for every container is locked, and the only possible action is to pull the depository container 14 half way out to the position shown in FIG. 4. It will go no further until its door is locked. When the key 15 is turned from the position shown in FIG. 4, the container lock 16 locks the door and the key 15 can be removed from the lock 16 and swung to the position shown in FIG. 5.

Then the depository container 14 can be removed as shown in FIG. 5 freeing the divert container key 21, illustrated in FIG. 6. The divert container key 21 must be moved from the position shown in FIG. 6 to that of FIG. 7 to lock the divert container 13. The key then is moved to the position of FIG. 8 permitting removal of the divert container 13 as shown in FIG. 9.

Removal of the divert container 13 allows the control handle 26 to be raised from the normal position of FIGS. 9 and 10 to the intermediate position shown in FIGS. 11 and 17. The control handle 26 is stopped at the intermediate position. When handle 26 is in intermediate position, the note container keys 52 may be turned in their locks 55 to lock the containers 9. Then the keys 52 are withdrawn from the locks 55 as shown in FIG. 20. The control handle 26 then may be raised to the position of FIG. 22 which unlatches the closure housing 10 which may be opened as shown in FIG. 23 and the note containers 9 can now be removed.

The foregoing sets forth the sequence of the various disassembly operations that must be carried out without variation or omission.

With all containers removed the sequence of assembly operations of the various sealed tamper-indicating containers now are described below.

The note containers 9 being delivered by a courier and containing new supplies of notes are inserted in the positions shown in FIG. 13 with the closure housing open. Neither the divert nor the deposit containers can be installed ahead of the note containers 9.

Next, the closure housing 10 is closed to latched position and the control handle 26 moved to intermediate position shown in FIGS. 11 and 20. At this time, the control handle 26 is frozen in intermediate position because it cannot be moved further down from the position of FIG. 20 since the angular lever 30 connected to the control handle 26 through lever arm 29 cannot have its upper end moved downward. Such movement is prevented by the pins 32 at the upper ends of levers 30 which are engaged in the note container door recesses 34 and **34*b* holding the angular levers 30 in the position shown in FIG. 20 on account of the container doors 35** being locked in closed position.

That is to say, until the note container locks 55 are unlocked, the container doors 35 are held closed and when held closed prevent the angular levers 30 from being moved from the position of FIG. 20 thereby preventing the control handle 26 from being moved out of intermediate position.

The knobs 45 and key actuator rods 44 then may be pushed inward from the position of FIG. 20 to that of FIG. 17 to engage the keys 52 with the note container locks 55. Then the knobs are turned to unlock the locks 55. The control handle 26 is held in intermediate position until the locks 55 are unlocked, and in this position the control handle blocks installing the divert container 13. At the same time the divert container key, as shown in FIGS. 8 and 9, prevents installation of the depository container 14.

The control handle 26 now is moved down to the normal position of FIG. 14 which is accompanied by opening the doors 35 of the note containers 9.

Movement of the control handle 26 to the lower normal position shown in FIG. 14 permits the divert container 13 to be installed as shown in FIGS. 14 and 8. Divert container key 21 held by the unit then may be inserted and turned to the position shown in FIG. 6 to unlock the divert container and permit installation of the depository container 14.

The depository container can only be inserted half way, as shown in FIG. 4, when its key 15 must be inserted in its lock 16 and the lock unlocked so that the container can be pushed all the way into the unit as shown in FIG. 3. The security door (not shown) for the ATM cabinet 1 can only be closed and locked if the depository container 14 is all the way in position within the cabinet because otherwise, if in the position of FIG. 4, the container 14 will interfere with the security door being closed.

Further, the depository container can only be all the way in the cabinet in the operative position in the ATM 1 if every other container is in the correct operative position.

There is also another safeguard provided for an ATM having a divert container 13, or a depository container 14, or both, in addition to one or more note containers 9. The function of divert and depository containers 13 and 14 is different from the function of note containers 9. Note containers 9 have paper money notes contained therein which are withdrawn from the containers 9 and dispensed in normal operation of the ATM. On the other hand, divert and depository containers 13 and 14 receive and store material discharged into the containers.

This differential function, unless protective measures are taken, can permit an untrustworthy security messenger to defeat security, (for a time at least) during loading of new note containers 9 into an ATM by failing to load either or both of divert containers 13 and 14.

If the messenger omits loading divert or depository containers in an ATM, diverted or deposited material during subsequent ATM operation is discharged from the mechanism directly inside of the protective cabinet of the unit. At a later time, the untrustworthy security messenger can return to the unit, open the cabinet, withdraw the loose deposited or diverted material, and then properly load a divert container 13 and depository container 14 into the ATM, and make away with the material withdrawn.

To guard against such fraudulent activities a depository indicator switch 75 may be mounted on the ATM frame as indicated in FIG. 5 which is actuated to a signaling or indicator or control position as shown in FIG. 4 when a depository container 14 is loaded into the ATM by engagement of the actuator of the switch 75 by the door of the container as shown.

Similarly, a divert container indicator switch 76 may be mounted on the closure housing 10 (FIG. 12) which is engaged and actuated by a divert container 13 when loaded in the ATM.

The indicator switches 75 and 76 preferably are connected in the control circuitry for the ATM so that the ATM is not operative unless the switches 75 or 76, or both, are closed in positions indicating that the depository container 14 and the divert container 13 are actually loaded in the ATM.

Accordingly, the multiple, diverse-function, sealed containers have interlocking mechanisms and relationships which require assembly or disassembly in step-by-step predetermined sequences which must be carried out without variation or omission; and the interlocking relationships described satisfy the stated objectives and insures maximum security in the operation and use of ATM's, thereby satisfying a need existing in the field of automatic remote banking equipment and services.

In the foregoing description, certain terms have been used for brevity, clearness and understanding but no necessary limitations are to be implied therefrom beyond the requirements of the prior art because such terms are used for descriptive purposes and are intended to be broadly construed.

Moreover, the description and illustration of the invention is by way of example, and the scope of the invention is not limited to the exact details shown or described.

Having now described the features, principles and cooperative relationships of the new structures, and the advantageous, new and useful results obtained, the new structures, devices, components, elements, arrangements, parts, combinations and relationships are set forth in the appended claims.

We claim:

1. An ATM having multiple, diverse-function, sealed, tamper-indicating containers removably located therein including a depository container, a divert container and at least one note container; each container having a door mounted thereon movable between positions opening or closing an access opening formed in such container; a lock on each container locking the container door closed when in locked mode outside of and as loaded into the ATM; a lock actuator mounted on the ATM for each container lock operative to engage and actuate to unlocked mode the lock of its respective container when the latter is loaded into the ATM and to hold such container loaded in the ATM; each such lock actuator acting as a control preventing either such lock actuator or an adjacent container from being loaded into the ATM when its lock is not in unlocked mode; and interlock means operatively connecting said containers one to another and to the ATM when said containers are loaded in the ATM in ATM operative status; whereby such lock actuators acting as controls to be actuated in a sequence of steps without omitting any step during assembly or disassembly, thereby rendering the ATM impervious to misloading and maintaining container integrity at all times.

2. An ATM having multiple, diverse-function, sealed, tamper-indicating containers removably located therein including a depository container, a divert container and at least one note container; each container having an access opening provided with door means in open position when the ATM is loaded and in operative status; the depository container through its access opening receiving banking media deposited in the ATM; currency being dispensed by the ATM being discharged from said at least one note container through its access opening; currency diverted from being dispensed for cause being received in the divert container through its access opening; interlock means operatively connecting said containers one to another and to the ATM when said containers are loaded in the ATM in ATM operative status with their respective access openings open; and said interlock means including controls constructed and arranged to be actuated in a sequence of steps without omitting any step during assembly or disassembly, thereby rendering the ATM impervious to misloading and maintaining container integrity at all times.

3. An ATM having multiple, diverse-function, sealed, tamper-indicating containers removably located therein including a depository container, a divert container and at least one note container; each container having an access opening provided with door means; each container having lock means; the lock means holding the door means in positions closing their respective access opening prior to and during loading; lock actuator means for each container lock means mounted in the ATM on a mounting member; each of said mounting members being movably mounted on the ATM; each actuator means being engaged with its respective lock means during loading of the ATM; each actuator means being operated after engagement with its respective lock means to unlock such lock means during loading to establish interlocks connecting said containers one to another and to the ATM when said containers are loaded in the ATM in ATM operative status; whereby said actuator means are actuated in a sequence of steps without omitting any step during assembly or disassembly, thereby rendering the ATM impervious to misloading and maintaining container integrity at all times.

4. An ATM having multiple, diverse-function, sealed, tamper-indicating containers removably loaded therein including a divert container and at least one note container; interlock means operatively connecting said containers one to another and to the ATM when said containers are loaded in the ATM in ATM operative status; a closure housing pivotally mounted on the ATM movable between open and closed positions preventing access to said at least one note container when the closure housing is in closed position; a control handle for the closure housing pivotally mounted on the pivot axis of the closure housing; latch means for the closure housing normally latching the closure housing closed; the control handle being movable between normal position and a position unlatching said latch means to thereby permit opening of the closure housing; the divert container, until removed from the ATM, preventing movement of the control handle to said position unlatching said latch means; and said interlock means including controls constructed and arranged to be actuated in a sequence of steps without omitting any step during assembly or disassembly, thereby rendering the ATM impervious to misloading and maintaining container integrity at all times.

5. An ATM having multiple, diverse-function, sealed, tamper-indicating containers removably loaded therein including a divert container and at least one note container; interlock means operatively connecting said containers one to another and to the ATM when said containers are loaded in the ATM in ATM operative status; a closure housing pivotally mounted on the ATM movable between open and closed positions preventing access to said at least one note container when the closure housing is in closed position; a control handle for the closure housing pivotally mounted on the pivot axis of the closure housing; latch means for the closure housing including, a spring blade mounted on the ATM and an angular flange mounted on the closure housing, said blade and flange normally being interengaged latching the closure housing closed; the control handle being movable between normal and delatching positions; push rod means mounted on the closure housing actuated when the control handle is moved to delatching position to unlatch said blade and flange and to thereby permit opening of the closure housing; the divert container, until removed from the ATM, preventing movement of the control handle to delatching position; and said interlock means including controls constructed and arranged to be actuated in a sequence of steps without omitting any step during assembly or disassembly, thereby rendering the ATM impervious to misloading and maintaining container integrity at all times.

6. An ATM having multiple, diverse-function, sealed, tamper-indicating containers removably loaded therein including a depository container, a divert container and at least one note container; the divert container having an access opening provided with a door; a lock for said door; key means for said lock movably mounted on the ATM; said key means being engaged in said lock holding said lock unlocked and holding said door open when the divert container is loaded in the ATM in ATM operative status; a rail member mounted on the depository container interlocked with said key means when the latter is engaged in said lock in unlocked position to prevent actuation of said key means to move said lock to a position closing and locking said door; interlock means operatively connecting said at least one note container to said divert container and to the ATM when said containers are loaded in the ATM in ATM operative status; and said lock, said key means, said rail member, and said interlock means including controls constructed and arranged to be actuated in a sequence of steps without omitting any step during assembly or disassembly, thereby rendering the ATM impervious to misloading and maintaining container integrity at all times.

7. The construction defined in claim 6 in which the divert and depository containers each actuate an indicator switch to indicate and signal that said divert and depository containers actually have been loaded in the ATM.

8. A method of removably loading ATM's under conditions of maximum security with diverse-function, sealed, tamper-indicating containers wherein such containers include a depository container for receiving deposits when loaded in the ATM, a divert container for receiving notes diverted for cause during ATM operation, and at least one note container having paper money notes stacked therein for being dispensed by the ATM, and wherein such containers each have an access opening closed by a door, locked by a lock mounted on the respective container, and wherein said container locks are locked with the container doors closed when loaded, the steps of:

(a) inserting at least one note container into at least one cavity in the ATM;
(b) moving a closure housing pivotally mounted on the ATM to a latched position enclosing said at least one note container;
(c) moving a control handle for said closure housing to an intermediate position which releases container key means mounted on the closure housing for insertion into said at least one note container lock;
(d) inserting said key means into said at least one lock and actuating said key means to unlock said at least one lock while blocking movement of said control handle out of intermediate position toward unlatched position and permitting control handle movement to normal ATM operative position;
(e) moving said control handle out of intermediate position where it blocks mounting a divert container on said closure housing, to normal position;
(f) mounting a divert container on said closure housing;
(g) inserting a divert container key carried by the ATM into the divert container lock and unlocking said lock;
(h) loading a depository container having an interlock member blocking actuation of the divert container key from unlocked position into a cavity in the ATM;
(i) inserting a depository container key carried by the ATM into the depository container lock and unlocking said lock; and
(j) then moving the depository container to fully loaded position to open said depository access opening door.

9. A method of removing diverse-function, sealed, tamper-indicating containers loaded in an ATM from such ATM under conditions of maximum security wherein such containers include a depository container for receiving deposits when loaded in the ATM, a divert container for receiving notes diverted for cause during ATM operation, and at least one note container having paper money notes stacked therein and being dispensed by the ATM, and wherein such containers each have an access opening closed by a door, adapted to be locked by a lock mounted on the respective container, and wherein said container locks each have a key held sealed to and movably mounted on the ATM which are engaged with their respective locks, holding such locks unlocked with the container doors open when loaded in the containers in ATM operative status, the steps of:

(a) pulling the depository container partially out of the ATM to close its door over its access opening;
(b) actuating the depository container key to locked state to lock the depository door closed;
(c) removing the depository container key and then removing the depository container to permit access to actuate the divert container key blocked in unlocked state by the depository container;
(d) actuating the divert container key to locked state to lock the divert container door closed;
(e) removing the divert container key and then removing the divert container to permit access to a control handle of a closure housing pivotally mounted on the ATM enclosing loaded said at least one note container so that the control handle can be moved from normal position to an intermediate position;
(f) then moving said control handle to intermediate position thereby releasing key actuator means carried by the closure housing to permit the actuator means to move key means carried by the actuator means and engaged with said at least one note container lock means to actuate said at least one note container key means to locked state;
(g) removing said at least one note container key means from their respective lock means permitting said at least one note container key means to be removed from their locks thereby unblocking said control handle for movement from intermediate position to an unlatching position;
(h) moving the control handle to unlatching position thereby unlatching the closure housing from the ATM;
(i) opening said closure housing to provide access to the said at least one note container; and
(j) then removing the at least one note container from the ATM.

* * * * *